US007004249B2

(12) United States Patent
Lohbeck

(10) Patent No.: US 7,004,249 B2
(45) Date of Patent: Feb. 28, 2006

(54) METHOD OF TRANSFERRING FLUIDS THROUGH A PERMEABLE WELL LINING

(75) Inventor: Wilhelmus Christianus Maria Lohbeck, Rijswijk (NL)

(73) Assignee: Shell Oil Company, Houston, TX (US)

( * ) Notice: Subject to any disclaimer, the term of this patent is extended or adjusted under 35 U.S.C. 154(b) by 178 days.

(21) Appl. No.: 10/312,424

(22) PCT Filed: Jun. 28, 2001

(86) PCT No.: PCT/EP01/07421

§ 371 (c)(1),
(2), (4) Date: Apr. 11, 2003

(87) PCT Pub. No.: WO02/01042

PCT Pub. Date: Jan. 3, 2002

(65) Prior Publication Data

US 2004/0007363 A1 Jan. 15, 2004

(30) Foreign Application Priority Data

Jun. 29, 2000 (EP) ..... 00202283

(51) Int. Cl.
*E21B 43/10* (2006.01)

(52) U.S. Cl. ..... 166/208; 166/227; 166/242.2

(58) Field of Classification Search ..... 166/278, 166/227, 305.1, 381, 307, 308.1, 285, 242.2, 166/208

See application file for complete search history.

(56) References Cited

U.S. PATENT DOCUMENTS

| | | | | |
|---|---|---|---|---|
| 2,215,913 | A * | 9/1940 | Brown | 166/285 |
| 3,683,056 | A | 8/1972 | Brandt et al. | |
| 4,598,777 | A | 7/1986 | Park et al. | |
| 4,778,007 | A | 10/1988 | Van Laar | |
| 5,163,512 | A * | 11/1992 | Brewer et al. | 166/313 |
| 5,507,345 | A * | 4/1996 | Wehunt, Jr. et al. | 166/285 |
| 5,701,955 | A | 12/1997 | Frampton | |
| 5,730,223 | A * | 3/1998 | Restarick | 166/380 |
| 5,823,260 | A | 10/1998 | McConnell et al. | |
| 5,909,773 | A | 6/1999 | Koehler et al. | |
| 6,026,900 | A | 2/2000 | Keller | |
| 2004/0016543 | A1 * | 1/2004 | Crawshaw et al. | 166/276 |

FOREIGN PATENT DOCUMENTS

| | | |
|---|---|---|
| EP | 0 718 464 A1 | 6/1996 |
| EP | 0 933 414 A1 | 8/1999 |
| EP | 0 952 305 A1 | 10/1999 |
| WO | 97/17524 | 5/1997 |
| WO | 99/45876 | 9/1999 |
| WO | 99/56000 | 11/1999 |

* cited by examiner

*Primary Examiner*—David Bagnell
*Assistant Examiner*—Daniel P. Stephenson
(74) *Attorney, Agent, or Firm*—Rachael Stiegel

(57) ABSTRACT

A fluid is transferred between surface facilities and a subsurface reservoir formation through a well, which is equipped with a well lining having a permeability of less than 50 Darcy and preferably a lower permeability than at least part of the reservoir formation in the vicinity of the well lining so that fluid transfer into or from the formation is equalized even if the formation comprises strata having different permeabilities.

20 Claims, 1 Drawing Sheet

METHOD OF TRANSFERRING FLUIDS THROUGH A PERMEABLE WELL LINING

BACKGROUND OF THE INVENTION

Figure 1:
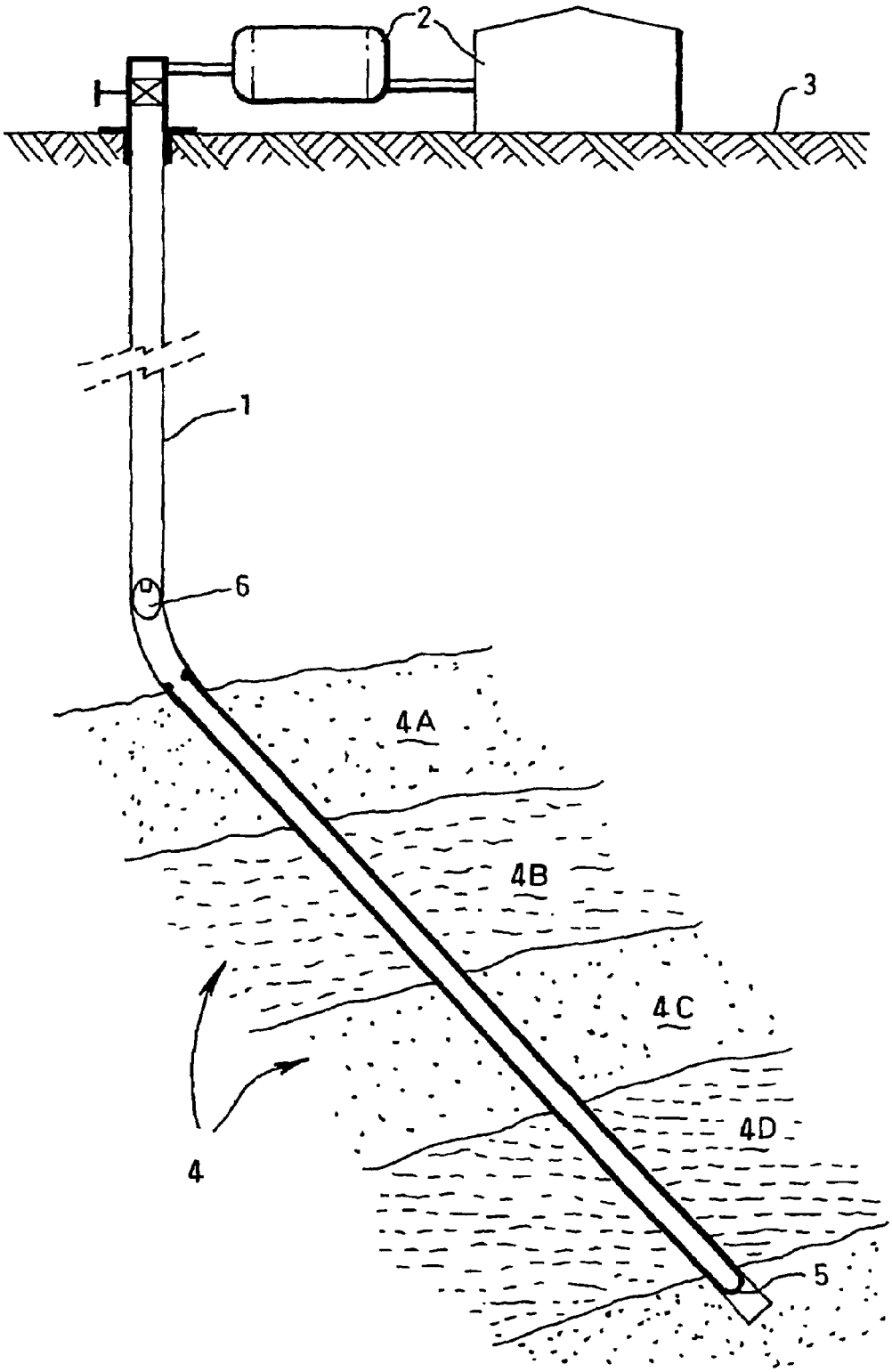

The invention relates to a method of transferring fluids through a permeable well lining.

Such a method is known from International patent application PCT/EP96/04887.

The well lining known from this prior art reference serves as a sand/gravel screen and therefore has a sieve opening size, which is smaller than the size of the sand/gravel particles that are to be excluded from the wellbore. However, this and other known sandscreens typically only represent a limited flow restriction in order to avoid that the influx of well effluents is inhibited. The permeability of this and other conventional well screens is typically several thousands Darcy and is much higher than the permeability of the surrounding formation which may have a permeability which is less than 50 Darcy, or even as low as 1 mDarcy in carbonate formations.

Therefore, the method of transferring fluid between a reservoir formation and fluid processing facilities at or near the earth surface via a well extending between said formation and facilities, which well is equipped with a permeable well lining, is known from International patent application PCT/EP96/04887.

A problem encountered with production of hydrocarbon fluids from subsurface reservoirs and with injection of steam, water or treatment into such reservoirs is that such reservoirs may be stratified and that some zones may have a significantly higher permeability than other zones so that the transfer of fluid into or from the well is largely concentrated to the high permeability zones.

It is an object of the present invention to provide a method of transferring fluids through a permeable well lining, which alleviates the problem of an unequal fluid transfer along the length of the lining, in particular if the well lining traverses stratified reservoir zones having different permeabilities.

SUMMARY OF THE INVENTION

In the method according to the invention fluid is transferred between a subsurface formation and fluid processing facilities at the earth surface via a well, which is equipped with a well lining, which has a permeability which is lower than 50 Darcy.

Preferably the permeability of the well lining is lower than the permeability of at least part of the subsurface formation in the vicinity of the well lining.

Preferably the well traverses several zones of a subsurface hydrocarbon bearing reservoir formation, which zones have different permeabilities and the permeability of the well lining is selected lower than the permeability of the zone having the highest permeability whilst fractures or cavities will not be taken into account for determining the permeability of the lining. If the permeability of the reservoir zone having the highest permeability is about 20 Darcy then the permeability of the well lining would be selected lower than 20 Darcy.

Suitably, the well lining is unfolded and/or expanded downhole and pressed against the wall of the wellbore or perforated production liner and is made of a low permeable screen material such as a fabric, permeable rubber, a woven or sintered metal screen or a laser punched metal plate.

The well lining may be formed by an expandable hose or bladder, which is pressed against the wall of the wellbore either by mechanical force or by hydraulic pressure in case fluid is injected from the well into the formation. Alternatively, the well lining may be expanded by inflating a hose or bladder inside the lining or by expanding a slotted or perforated corrugated, cellular or foldable tubular within the lining.

The transferred fluid may be steam, acid, gel, surfactant, resin, a one or multiple component cement, or a treatment or stimulation fluid, which is pumped down from surface facilities through the well and well lining into the formation.

Alternatively, the fluid is a hydrocarbon fluid and/or water, which flows from the reservoir formation via the well lining and well towards hydrocarbon fluid processing facilities at or near the earth surface, whereas the produced water may be separated downhole from the produced well fluid and be re-injected into a subsurface formation.

It is observed that International patent application PCT/EP99/03013 discloses a cellular well tube of which the cells may be filled with a one- or two-component cement slurry or treatment fluid, which is squeezed evenly into the surrounding formation or annulus through the outer wall of the cells, which wall may have a lower permeability than the surrounding formation. The fluid is pre-loaded in these cells and the known method can therefore only be used to inject a relatively small volume of fluid evenly into the formation, which volume equals that of the cells of the tube. The known method therefore is not a process where a significant amount of fluid is transferred via pumping or otherwise during a prolonged period of time between surface fluid processing facilities and a subsurface reservoir formation. Furthermore leaking longitudinal gaps may be formed between the various cells of the cellular tube, which gaps will reduce the equalization of the fluid injection into formation layers with different permeabilities.

It is also observed that conventional sandscreens may become plugged with fines that are trapped within the screen. However, in such case the fines are decreasing the permeability of the sieve openings of the screen, whereas the permeability of the screen itself will remain a few thousand Darcy.

DESCRIPTION OF A PREFERRED EMBODIMENT

The invention will be explained in more detail with reference to FIG. 1, which shows a well traversing a stratified reservoir formation.

The well 1 extends from fluid processing facilities 2 at the earth surface 3 into a stratified subsurface reservoir formation 4.

The four strata 4A–D of the formation 4 each have different permeabilities. Strata 4B and 4D may be oil-bearing strata having a relatively low permeability of for example less than 10 Darcy.

Stratum 4A may be gas-bearing and stratum 4C may be water-bearing and these strata may have a permeability of for example between 10 and 50 Darcy.

The fluid inflow zone of the well 1 is equipped with a well lining 5 having a lower permeability than the gas- and water-bearing strata 4A and 4C. As a result of the low permeability of the lining 5, which in the example shown will be selected somewhere between 1 and 50 Darcy, the variation of influx from the different strata 4A–4D is reduced.

In order to counteract production losses as a result of the low permeability of the lining 5 a downhole pump 6 may be installed in the well.

If steam, acid or another production stimulation or treatment fluid is to be injected through the lining 5 into the formation 4 then the low permeability of the lining 5 will equalize the fluid injection rate into various strata 4A–4D so that fluid losses into the most permeable strata 4A and 4 are reduced and an effective stimulation or treatment of the oil-bearing strata 4B and 4D is established.

If the formation 4 is fractured or contains cavities the lining 5 will also equalize the fluid injection rate into the various strata 4A–4D so that fluid losses into the fracture or cavities are reduced and an effective stimulation or treatment of the oil-bearing strata 4B and 4D is established. In such case the very high permeability of the fracture or cavity will be ignored and the permeability of the lining 5 will be selected lower than the permeability of the most permeable unfractured stratum 4A–4D, which will be less than 50 Darcy.

The method according to the invention is not only useful for establishing an equal fluid transfer between an oil or gas production or fluid injection well and a subsurface oil and/or gas bearing formation but is also useful for injecting treatment fluids equally from a clean-up well into a formation which is polluted with chemicals and to extract these chemicals from the polluted formation in an equal manner along the length of the clean-up well.

The invention claimed is:

1. A method of transferring fluid between a subsurface formation and fluid processing facilities at or neat the earth surface via a well extending between said subsurface formation and fluid processing facilities, wherein the fluid is transferred via a permeable well lining that is not a sand screen, gravel pack, or combination thereof, which has a permeability of less than 50 Darcy; characterised in that the well traverse several zones of a subsurface reservoir formation, which zones have different permeabilities and the permeability of the well lining is selected lower than the permeability of the zone having the highest permeability.

2. The method of claim 1, wherein the permeability of the well lining is less than 10 Darcy.

3. The method of claim 1, wherein the well lining is unfolded or expanded downhole and pressed against the wall of the wellbore or perforated production liner either by mechanical force or by hydraulic pressure and is made of a low permeable screen material selected from the group consisting of a fabric, permeable rubber, a woven or sintered screen or a laser punched plate.

4. The method of claim 3, wherein the well lining is formed by an expandable hose or bladder, which is pressed against the wall of the wellbore either by mechanical force or by hydraulic pressure in case fluid is injected from the well into the formation.

5. The method of claim 3, wherein the well lining is pressed against the wall of the borehole or a perforated production liner by an expandable slotted tubular which is brought into a tubular shape downhole.

6. The method of claim 3, wherein the well lining is formed by an expandable perforated tubular or by a corrugated or foldable tubular which is brought into a tubular shape downhole.

7. The method of claim 3, wherein the well lining is pressed against the wall of the borehole or a perforated production liner by a perforated tubular which is brought into a tubular shape downhole.

8. The method of claim 3, wherein the well lining is pressed against the wall of the borehole or a perforated production liner by a perforated corrugated tubular which is brought into a tubular shape downhole.

9. The method of claim 3, wherein the well lining is pressed against the wall of the borehole or a perforated production liner by a cellular which is brought into a tubular shape downhole.

10. The method of claim 3, wherein the well lining is pressed against the wall of the borehole or a perforated production liner by a foldable tubular which is brought into a tubular shape downhole.

11. The method of claim 1, wherein fluid is pumped from said fluid processing facilities via the well and well lining into the reservoir formation.

12. The method of claim 11, wherein the steps of pumping of fluid from said fluid processing facility is alternated with fluid compromising a hydrocarbon fluid flowing from a subsurface reservoir formation via the well lining and well.

13. The method of claim 11, wherein the fluid is steam.

14. The method of claim 11, wherein the fluid is gel.

15. The method of claim 11, wherein the fluid is surfactant.

16. The method of claim 11, wherein the fluid is resin.

17. The method of claim 11, wherein the fluid is one or two component cements.

18. The method of claim 11, wherein the fluid is stimulation fluid.

19. The method of claim 11, wherein the fluid is treatment fluid.

20. The method of claim 1, wherein the fluid comprises a hydrocarbon fluid, which flows from a subsurface reservoir formation via the well lining and well towards hydrocarbon fluid processing facilities at or near the earth surface.

* * * * *